US008526625B2

(12) United States Patent
Akino

(10) Patent No.: US 8,526,625 B2
(45) Date of Patent: Sep. 3, 2013

(54) STEREO MICROPHONE

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 371 days.

(21) Appl. No.: 12/883,830

(22) Filed: Sep. 16, 2010

(65) Prior Publication Data

US 2011/0069842 A1 Mar. 24, 2011

(30) Foreign Application Priority Data

Sep. 24, 2009 (JP) ..... 2009-218882

(51) Int. Cl.
*H04R 5/00* (2006.01)
*H04R 3/00* (2006.01)

(52) U.S. Cl.
USPC ..... 381/26; 381/111; 381/122

(58) Field of Classification Search
USPC ..... 381/26, 355–369, 111, 122; 49/26, 49/28
See application file for complete search history.

(56) References Cited

U.S. PATENT DOCUMENTS 4,628,525 A * 12/1986 Iwahara et al. ..... 381/26

FOREIGN PATENT DOCUMENTS

JP 57-23988 5/1982
JP 2002-374592 12/2002

OTHER PUBLICATIONS

Inventor: Sumitomo, Ichiro, Title: Stereo Microphone, Date: Mar. 2009, JP 2009049552 A, English machine translation.*
Japanese Office Action with English translation.

* cited by examiner

*Primary Examiner* — Vivian Chin
*Assistant Examiner* — Ammar Hamid
(74) *Attorney, Agent, or Firm* — Whitham Curtis Christofferson & Cook, PC

(57) ABSTRACT

A stereo microphone includes a supporter that is made of an elastic material. The supporter fixes two unidirectional microphone units at certain angles. A moving part is used to apply external force to a part of the supporter so that an angle formed by main axes of the respective unidirectional microphone units is changed by deformation of the supporter.

6 Claims, 4 Drawing Sheets

STEREO MICROPHONE

BACKGROUND OF THE INVENTION

1. Field of the Invention

The present invention relates to a stereo microphone, and more specifically, to a stereo microphone having more simple structure for making an angle formed by the main axes of respective two microphone units variable compared with that of a conventional counterpart.

2. Description of the Related art

An XY stereo system and an MS stereo system are known as a sound pickup system of a stereo microphone. In the XY stereo system, two unidirectional microphone units form an appropriate angle. The microphone unit directed to the left side and the microphone unit directed to the right side output an L channel output and an R channel output, respectively. The microphone units are mechanically fixed at positions in which the main axes thereof form an angle suitable for stereo sound pickup. A technique is known that can make an angle formed by the main axes of the respective microphone units variable (see, for example Japanese Utility Model Application Publication S57-23988).

In the MS stereo system, a unidirectional microphone unit and a bidirectional microphone unit are used. A main signal M obtained from the unidirectional microphone unit and a directional signal S obtained from the bidirectional microphone unit directed to a direction orthogonal to that of the unidirectional microphone unit are fed to a matrix circuit to generate (M+S) and (M−S) signals. For example, the (M+S) signal is an L channel output and the (M−S) signal is an R channel output (see for example, Japanese Patent Application Publication 2002-374592).

The XY stereo system, which can be established with a more simple circuit configuration compared with the MS stereo system, is mainly employed in a low-cost stereo microphone. The stereo microphone disclosed in Japanese Utility Model Application Publication S57-23988 is explained as an example of a conventional stereo microphone employing the XY stereo system. FIG. 3 is an overall view of the stereo microphone disclosed in Japanese Utility Model Application Publication S57-23988. FIG. 4 is an enlarged cross-sectional view of a casing of a microphone unit. In FIG. 3, this stereo microphone 100 includes a microphone casing 102 incorporating the microphone unit and a grip 103 for the user to hold the stereo microphone 100. The microphone casing 102 is provided with a rotary switch 104 at an external portion. The rotary switch 104 mechanically moves the direction of the microphone units incorporated in the microphone casing 102.

The microphone casing 102 incorporates: two microphone units 105 and 106 respectively forming the left and the right channels; microphone supporters 107 and 108 that mechanically support the microphone units 105 and 106, respectively; and a cam 109 that moves the microphone supporters 107 and 108 in accordance with the operation of the rotary switch 104 (see FIG. 3).

The directions of the microphone units 105 and 106 are changed by the movement of the microphone supporter 107 and 108 in accordance with the rotation of the cam 109 made by operating the rotary switch 104 (see FIG. 3). An angle formed by the main axes of the respective microphone units can be set to an angle (for example, 120 degrees) suitable for stereo sound pickup in the above-described manner.

As described with reference to the stereo microphone unit disclosed in Japanese Utility Model Application Publication S57-23988, a structure for mechanically changing and fixing an angle formed by the main axes of the respective microphone units requires many components other than a component for fixing the microphone units, e.g., a component for moving the microphone units or the fixing component, a component for maintaining a resultant angle of the movement by the moving component, and a component for changing the angle. Naturally, combination of such large number of components for making the angle formed by the main axes variable leads to a complex structure.

SUMMARY OF THE INVENTION

The present invention is made in view of the above and an object of the present invention is to provide a stereo microphone having a simple structure in which an angle formed by main axes of respective two unidirectional microphone units is variable.

In accordance with an aspect of the present invention, a stereo microphone includes: a supporter that is made of an elastic material and fixes two unidirectional microphone units at certain angles; and a moving part that applies external force to a part of the supporter when it is operated. An angle formed by main axes of the respective unidirectional microphone units is changed by deformation of the supporter when an external force using the moving part.

In the above described stereo microphone, the moving part preferably includes a slide operation unit and an intermediate unit that transmits the external force applied to the slide operation unit to the supporter.

In the above described stereo microphone, the intermediate unit is preferably a wire. The moving part is preferably configured to pull downward a part of the supporter.

In the above described stereo microphone, the intermediate unit preferably is a rod. The moving part is preferably configured to push upward a part of the supporter.

In the above described stereo microphone, the angle formed by the main axes is preferably changed in a step less manner.

In the above described stereo microphone, the angle formed by the main axes is preferably changed in a plurality of steps.

The present invention provides a stereo microphone in which an angle formed by the main axes of the respective microphone units can be varied to an angle suitable for stereo sound pickup. This is accomplished by applying an external force to the supporter made of an elastic material and to which the two capacitor microphone units are fixed.

DETAILED DESCRIPTION OF THE PREFERRED EMBODIMENTS

Figure 1A:
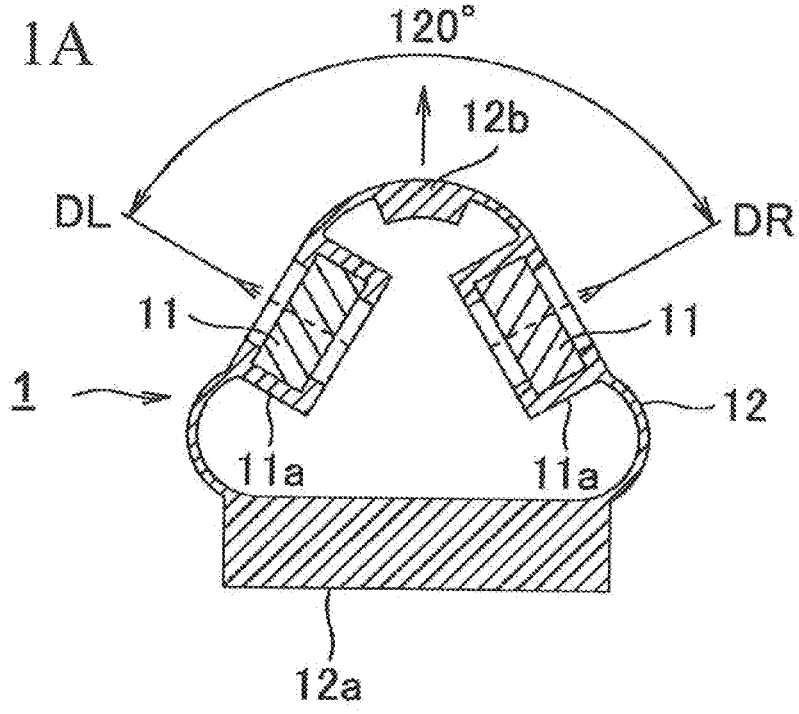
FIGS. 1A and 1B are cross-sectional views of an embodiment of a stereo capacitor microphone unit used in a stereo microphone according to the present invention.
Figure 1B:
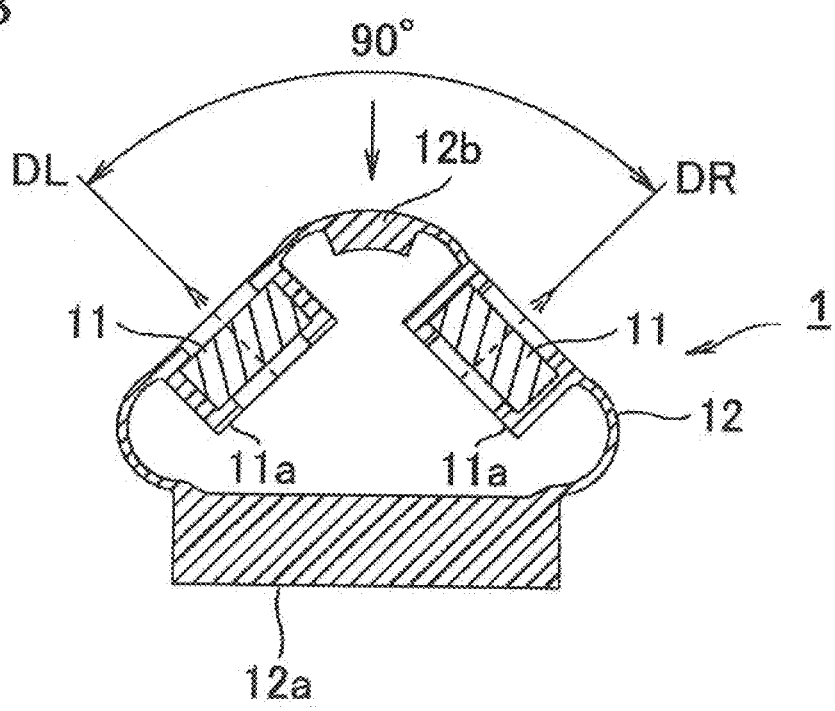

A stereo microphone according to the present invention is described below with reference to some of the accompanying drawings. FIGS. 1A and 1B are cross-sectional views of an embodiment of a stereo microphone unit used in the stereo microphone according to the present invention. As illustrated in FIGS. 1A and 1B, a stereo microphone unit 1 includes capacitor microphone units 11 (hereinafter, referred to as "units 11") respectively at the right side and the left side. The units 11 output a left channel sound signal and a right channel sound signal, respectively. The units 11 are fixed on a supporter 12 made of an elastic material. The supporter 12 has a bottom 12*a* fixed to a later-described microphone casing. The periphery of the supporter 12 protrudes upward, thereby forming a top 12*b* at the position above the center point of the bottom 12*a*. Thus, cross-sectional shape of the stereo microphone unit 1 is substantially triangular as illustrated in FIG. 1. The supporter 12 also serves as a shock mount for the units 11.

The supporter 12 is provided with fixers 11*a* respectively at left and right slopes in pair. The units 11 are respectively fit in the fixers 11*a* to be fixed to the supporter 12. An outer surface side of each of the fixers 11*a* and the rear surface of each of the units 11 are provided with a front acoustic hole and a rear acoustic hole, respectively.

In the supporter 12, which is made of an elastic material, a large angle is formed by main axes DL and DR respectively of the units 11 in the fixed state if the top 12*b* is pressed upward (see FIG. 1A), and a small angle is formed by main axes DL and DR respectively of the units 11 in the fixed state if the top 12*b* is pressed downward (see FIG. 1B).

The main axes DL and DR form an angle suitable for stereo sound pickup, e.g., the large angle should be about 120 degrees as illustrated in FIG. 1A and the small angle should be about 90 degrees as illustrated in FIG. 1B.

As described above, in the stereo microphone unit used in the stereo microphone according to the embodiment of the present invention, an angle formed by main axes of the respective units 11 can be varied by applying external force on the top 12*b* that is a part of the supporter 12 made of an elastic material. Thus, an angle formed by the main axes of the respective units 11 can be set and be fixed to a value suitable for stereo sound pickup with a simple structure.

An embodiment of the stereo microphone according to the present invention is described with reference to FIGS. 2A and 2B. The stereo microphone 10 includes the stereo microphone unit 1, the microphone casing 13 incorporating the stereo microphone unit 1, and a grip 14. The stereo microphone unit 1 is fixed inside the microphone casing 13. The microphone casing 13 is formed of a mesh material or is provided with multiple small holes, whereby sound can reach the stereo microphone unit 1.

The grip 14 includes an impedance converter such as a field electric transducer (FET) and a battery supplying power for the operation performed by the stereo microphone 10, both of which are not illustrated. The grip 14 is provided with a slide switch 16 of a sliding operational member. Ends of a wire 15 of a hard wire are connected to the slide switch 16 and the top 12*b* of the supporter 12, respectively.

A moving part of the stereo capacitor microphone 10 and the stereo capacitor microphone unit 1 according to the present invention is formed of the slide switch 16, the wire 15, and the top 12*b*. The wire 15 serves as an intermediate member through which the operational force applied to the slide switch 16 is transmitted to the top 12*b* of the supporter 12.

In the supporter 12 for the units 11, the top 12*b* is far from the bottom 12*a* due to the elastic force of the supporter 12 in a normal state where no external force is applied thereto. Thus, an angle formed by the main axes of the respective left and right units 11 is large. An angle formed by the main axes becomes small when external force against the elastic force of the supporter 12 is applied to the top 12*b* in the direction towards the bottom 12*a*.

Figure 2A:
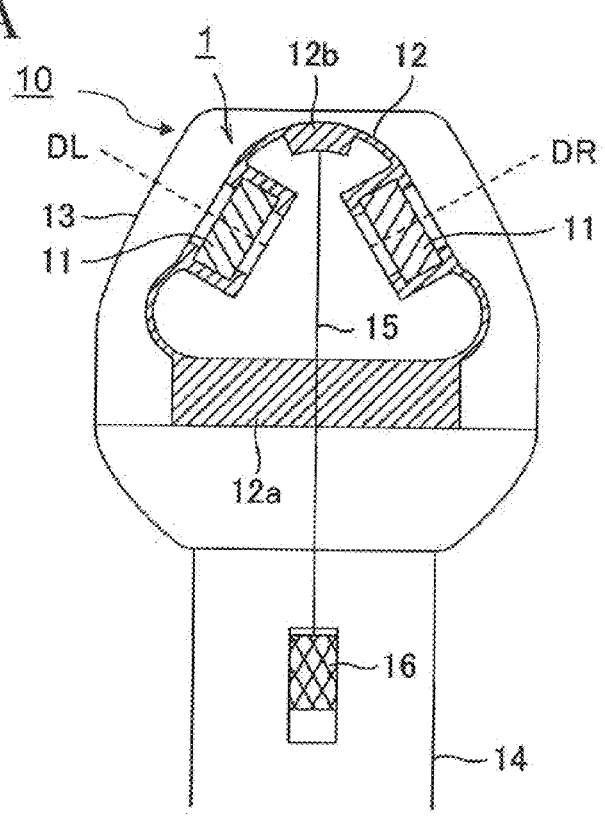
FIGS. 2A and 2B are cross-sectional views of an embodiment of the stereo microphone according to the present invention.

As illustrated in FIG. 2A, the upward movement of the slide switch 16 is accompanied by the movement of the top 12*b* towards the direction farther from the bottom 12*a* due to the elastic force of the supporter 12. Thus, the left and the right slopes become steep making the main axes DL and DR of the respective left and right units 11 face outward. As a result, an angle formed by the axes becomes large.

Figure 2B:
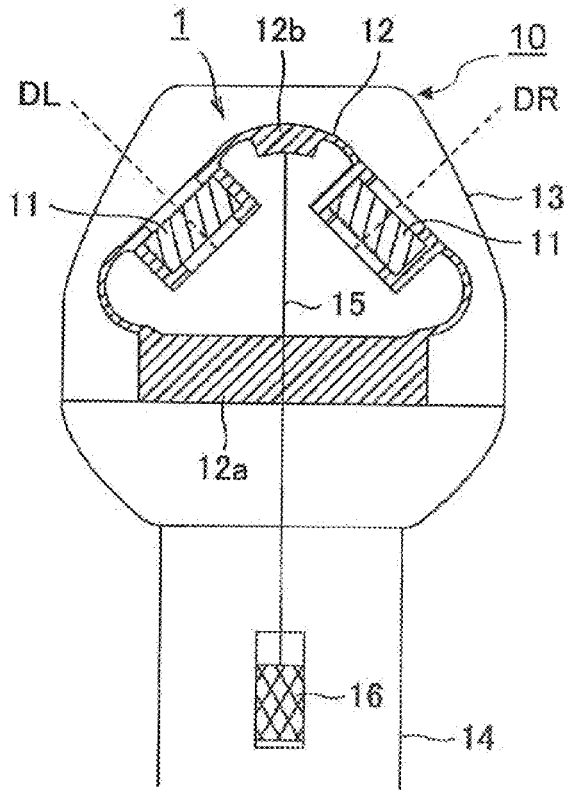
Figure 3:
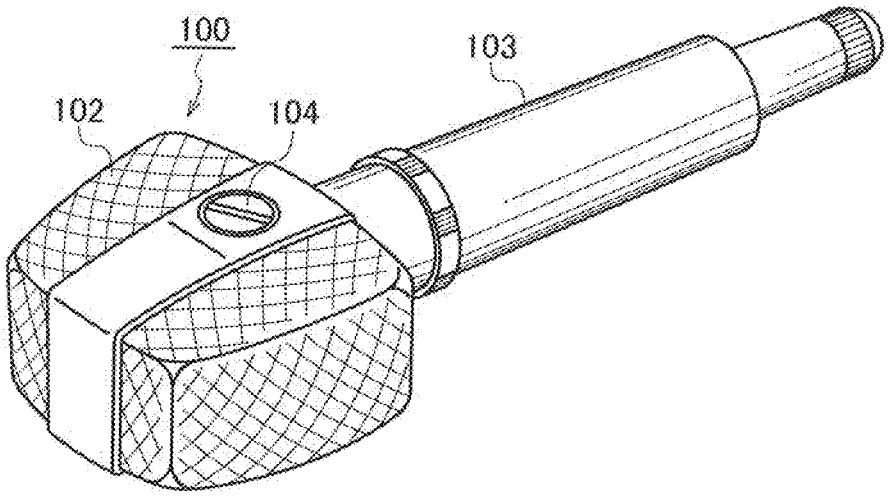
RELATED ART FIG.3
FIG. 3 is a perspective view of an example of a conventional stereo microphone.
Figure 4:
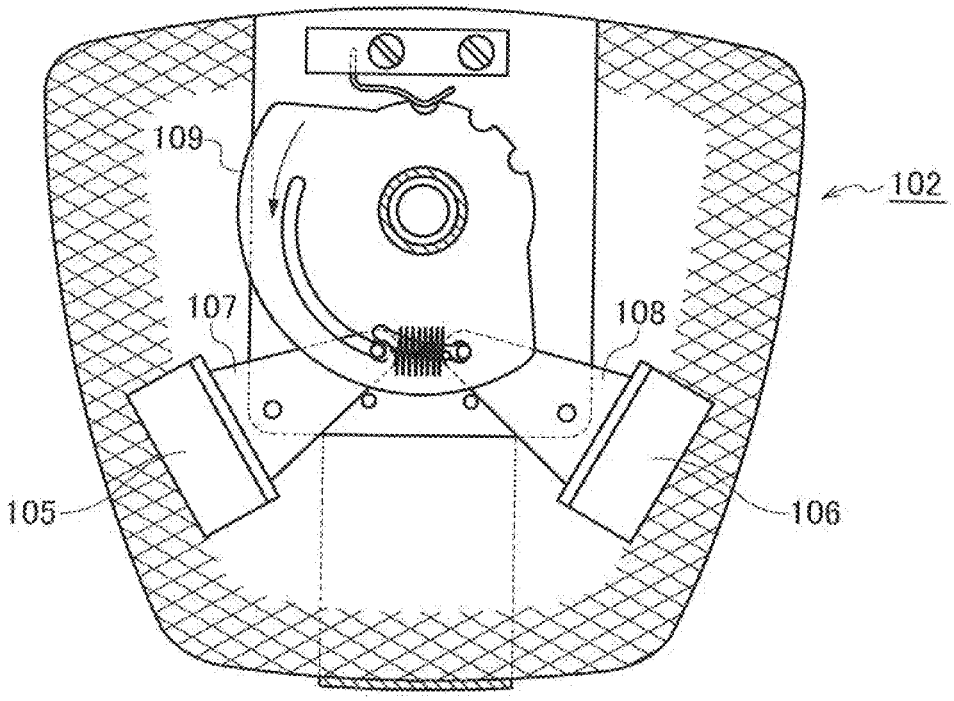
RELATED ART FIG.4
FIG. 4 is a transparent view illustrating the example of a conventional stereo microphone unit.

As illustrated in FIG. 2B, the downward movement of the slide switch 16 results in external force being applied to the top 12*b* via the wire 15 in the downward direction. The external force moves the supporter 12 in a downwardly pressed manner against its elastic force. Thus, the left and right slopes become softened making the main axes DL and DR of the respective left and right units 11 face inward. As a result, an angle formed by the axes becomes small.

The stereo microphone of which the directionality can be arbitrarily adjusted to any degrees from 90 to 120 degrees as required as described above can be obtained by setting the angle formed by the main axes of the respective units 11 when the slide switch 16 is at the upper movable limit to 120 degrees and setting the angle formed by the main axes of the respective units 11 when the slide switch 16 is at the lower movable limit to 90 degrees.

If the slide switch 16 can stay at any position within the movable range, the angle formed by the main axes of the respective units 11 can be of any value.

In the stereo microphone unit 1 in the stereo microphone 10 according to the present invention, the supporter 12, which is made of an elastic material, can serve as a shock mount that absorbs vibration generated while the stereo microphone 10 is used in a hand held state. Thus, the stereo microphone 10 can be used without being affected by the vibration noise.

The slide switch 16 and the top 12*b* of the supporter 12, which is connected by the wire 15 in the above described embodiment, can also be connected by a rod, i.e., a thin bar made of a rigid material. In this case, the supporter 12 is not required to have restoring force.

In the stereo microphone according to the above described embodiment, the directions of the left and the right unidirectional microphone units forming the stereo microphone are variable with a simple structure of the stereo microphone. Thus, an angle formed by the axes can easily be set to that suitable for stereo sound pickup.

What is claimed is:

1. A stereo microphone comprising:

a supporter that is made of an elastic material and fixes two unidirectional microphone units at certain angles, said supporter having a bottom, a top at a position above a center point of the bottom, and a shape that is substantially triangular in cross-section; and a moving part configured to apply external force to a part of the supporter, wherein an angle formed by main axes of the respective unidirectional microphone units is changed by deformation of the supporter.

2. The stereo microphone according to claim 1, wherein the moving part includes a slide operation unit and an intermediate unit, wherein the intermediate unit transmits an external force applied to the slide operation unit to the supporter.

3. The stereo microphone according to claim 2, wherein the intermediate unit is a wire, and the moving part is configured to pull downward the top of the supporter.

4. The stereo microphone according to claim 2, wherein the intermediate unit is a rod, and the moving part is configured to push upward the top of the supporter.

5. The stereo microphone according to claim 1, wherein the angle formed by the main axes is configured to be changed in a step less manner.

6. The stereo microphone according to claim 1, wherein the angle formed by the main axes is configured to be changed in a plurality of steps.

* * * * *